US005512880A

United States Patent [19]

Abrams et al.

[11] Patent Number: 5,512,880

[45] Date of Patent: Apr. 30, 1996

[54] WRIST BABY MONITOR

[75] Inventors: Randy L. Abrams, Leominster; Michael S. Bernstein, Natick, both of Mass.; David W. Crossley, Woonsocket, R.I.

[73] Assignee: Safety 1st, Inc., Chestnut Hill, Mass.

[21] Appl. No.: 409,847

[22] Filed: Mar. 27, 1995

[51] Int. Cl.[6] ..... G08B 23/00

[52] U.S. Cl. ..... 340/573; 340/539; 340/693; 455/347; 455/351; 455/899

[58] Field of Search ..... 340/573, 539, 340/693; 455/347, 899, 344, 351, 90

[56] References Cited

U.S. PATENT DOCUMENTS

| | | | |
|---|---|---|---|
| D. 344,907 | 3/1994 | Abrams et al. | D10/106 |
| D. 355,385 | 2/1995 | Abrams | D10/104 |
| D. 359,700 | 6/1995 | Abrams | D10/106 |
| 3,032,651 | 5/1962 | Gisiger-Stahli et al. | 455/269 |
| 4,510,350 | 4/1985 | Wagner | 379/38 |
| 4,754,285 | 6/1988 | Robitaille | 343/718 |
| 4,853,692 | 8/1989 | Wolk | 340/573 |
| 4,899,135 | 2/1990 | Ghahariian | 340/573 |
| 4,973,944 | 11/1990 | Maletta | 340/568 |
| 5,119,072 | 6/1992 | Hemingway | 340/573 |
| 5,144,325 | 9/1992 | Kurcbart | 343/718 |
| 5,196,825 | 3/1993 | Young | 340/539 |
| 5,210,532 | 5/1993 | Knoedler et al. | 340/573 |
| 5,280,296 | 1/1994 | Tan et al. | 343/718 |
| 5,303,421 | 4/1994 | Goldenberg | 455/344 |

OTHER PUBLICATIONS

"Walkabout 2000", Tomy Careline.

"Sound 'N Lights Monitor", Fisher–Price, Inc., pp. 1–10, 1991, 1992.

"Premier Nursery Monitor System", Gerry Baby Products Co.

"Two–Way Portable Family Intercom", Gerry Baby Products Co.

"Look 'N Listen Baby Monitor", Gerry Baby Products Co.

"Musical Sight & Sound Nursery Monitor", Safety 1st, Inc., p. 24, 1995 Juvenile Catalog.

*Primary Examiner*—Glen Swann

*Attorney, Agent, or Firm*—Wolf, Greenfield & Sacks

[57] ABSTRACT

A baby monitor receiver in the form of a wristwatch. A holder including a stand and cradle is provided for the receiver so that it may be stood on a flat surface or clipped to the clothing of the person attending to the baby.

12 Claims, 2 Drawing Sheets

WRIST BABY MONITOR

This invention relates to baby monitors and more particularly comprises a new wrist watch receiver that can be conveniently strapped to the wrist or be assembled with a holder to enable it to sit on a flat surface or be clipped onto the clothing of the person attending to the child.

Baby monitors are widely used to check on babies and young children while the person attending to the child is in a location remote from the child. Conventionally, the monitor system includes a transmitter which is placed in the area of the child and a receiver which is placed in the vicinity of the attendant and the system allows the attendant to listen to the child. Monitoring systems now available include receivers that can be clipped to the clothing of the attendant or alternatively placed on a stand resting on a surface such as a table or counter, but the receivers are quite large and cannot be worn as a watch about the wrist. Typically, the receivers are approximately 4"×3"×1½" or larger and simply cannot as a practical matter be strapped to the wrist.

In accordance with the present invention, the monitor receiver is miniaturized and can be worn just as a wristwatch. The receiver includes a holder comprising a cradle and stand assembly that enables the receiver to be clipped onto the clothing of the attendant or to stand on any available surface. The receiver includes a small housing provided with a flexible strap for securing it to the wrist. The housing includes a speaker as well as a digital clock and a monitor light indicating whether or not the unit is "on". The complimentary cradle and stand assembly is designed to accept the receiver and hold it firmly so that it will not accidentally fall from it. The cradle and stand assembly is operable in two modes, namely, in one mode the stand extends beneath the cradle and has a flat wall that will support the assembly on a horizontal surface, and a second mode wherein the cradle is nested closely within the stand so that they add a minimum bulk about the receiver. The cradle carries a clip that is in an operable position when the cradle and stand are closely nested together so that it is available to attach the assembly to the clothing of the person attending to the child.

The invention will be better understood and appreciated from the following detailed description of a preferred embodiment thereof, when in connection with the accompanying drawings.

BRIEF FIGURE DESCRIPTION

DETAILED DESCRIPTION

Figure 1:
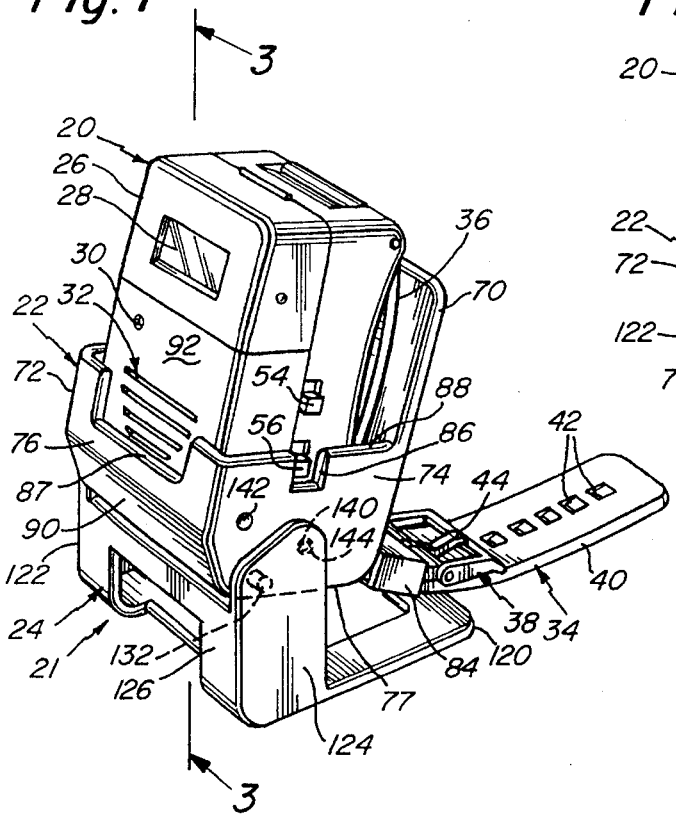
FIG. 1 is a perspective view of the monitor receiver of the present invention assembled with its cradle and stand, and resting on a flat surface such as a table or desk.
Figure 2:
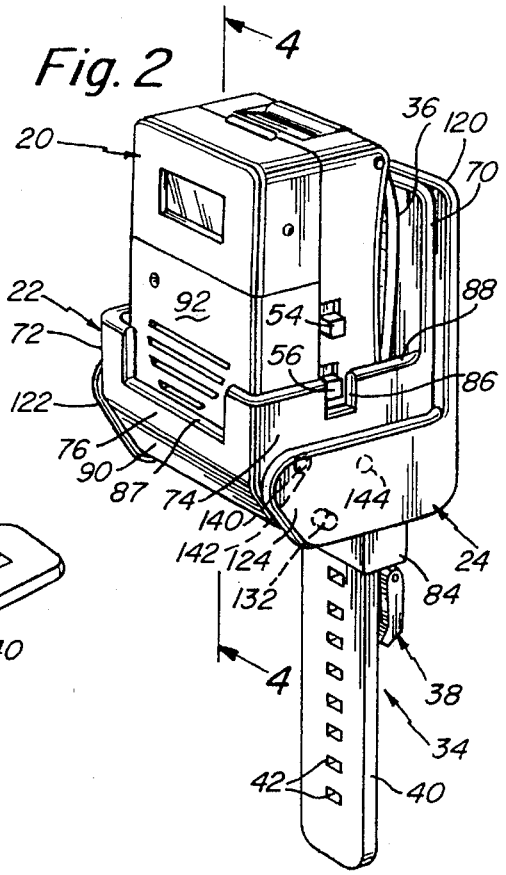
FIG. 2 is a perspective view of the combination receiver, cradle and stand assembled in the clip-on or hanging configuration.
Figure 7:
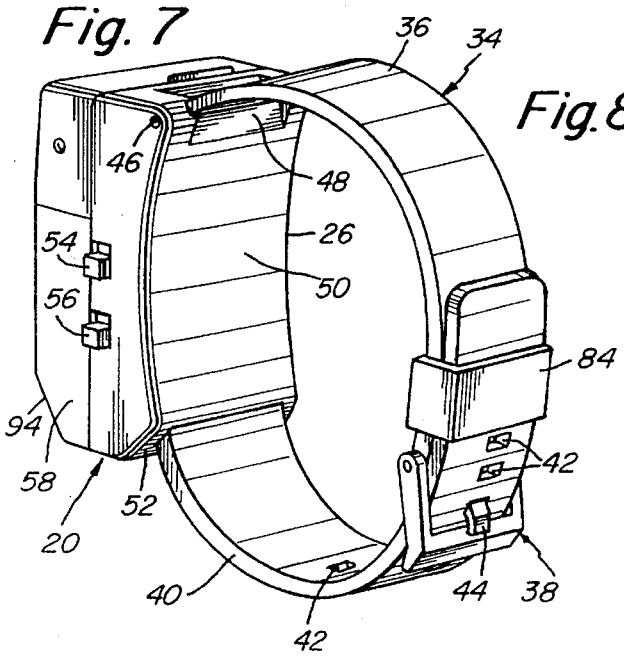
FIG. 7 is a rear perspective view of the receiver in the wristwatch configuration.

FIGS. 1, 2 and 7 show the monitor receiver of the present invention in the three different configurations in which it may be used, namely, (1) resting on a table or similar surface, (2) hanging from a belt or fabric such as an article of clothing and (3) encircling the wrist as a watch. All of these alternate methods of using the receiver are available and may be selected by the user as he or she desires. The receiver is shown at 20 and it may be worn alone as a wristwatch or in combination with its holder 21 made up of cradle 22 and stand 24 as a clip-on or resting on a surface, as desired.

The receiver 20 is packaged in a housing 26 and may have a variety of features. The embodiment shown has a digital time display 28, "on" display light 30, speaker 32 and wrist band 34 attached to the housing. As shown in FIG. 7, the band 34 has an upper strap 36, a clasp 38 and a lower strap 40 which is perforated as suggested at 42 to receive the pin 44 of the clasp. The upper strap 36 is secured by a pin 46 to the housing 26, and the strap 36 pivots freely on the pin by virtue of the recess 48 formed in the upper rear edge of the housing where the pin 46 attaches the strap to it. The lower strap 40 of the band is attached to the housing internally, and the details of that attachment are not shown. The housing has a contoured back surface 50 which enables it to lie comfortably against the back of The wrist. The lower strap 40 extends from the bevelled edge 52 at the bottom of the surface 50. A pair of switches 54 and 56 are carried on the side wall 58 of housing 26, which respectively turn the receiver on and off and switch the monitor between two channels for better reception and reduced noise. The details of the channel selector do not form part of the present invention.

As shown in FIG. 7, the receiver in the configuration described may be worn as a wristwatch and will not interfere with the normal activities of the wearer, but it will constantly provide the person wearing it with the ability to monitor the baby near whom the transmitter (not shown) of the monitor system is placed. The monitor system which includes the receiver of the present invention functions in the conventional manner.

Figure 3:
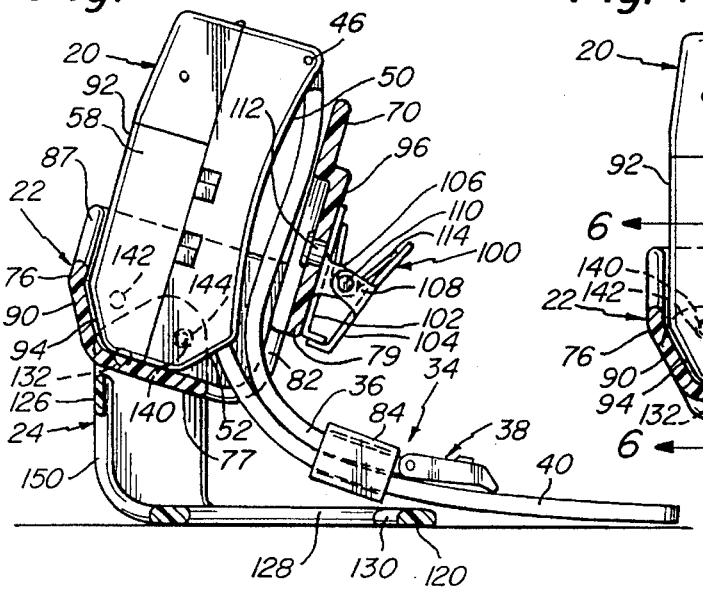
FIG. 3 is a cross-sectional view of the assembly shown in FIG. 1, taken along section line 3—3 in that figure.
Figure 4:
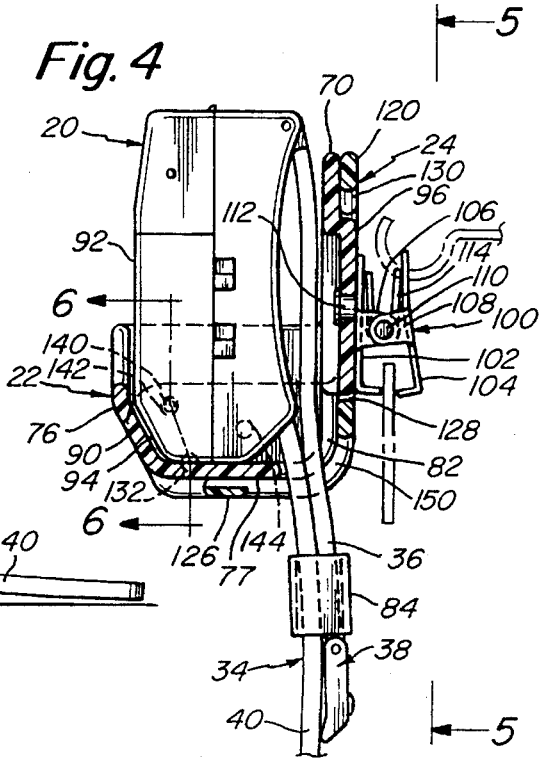
FIG. 4 is a cross-sectional view of the assembly shown in FIG. 2 taken along the section line 4—4 in that figure.
Figure 5:
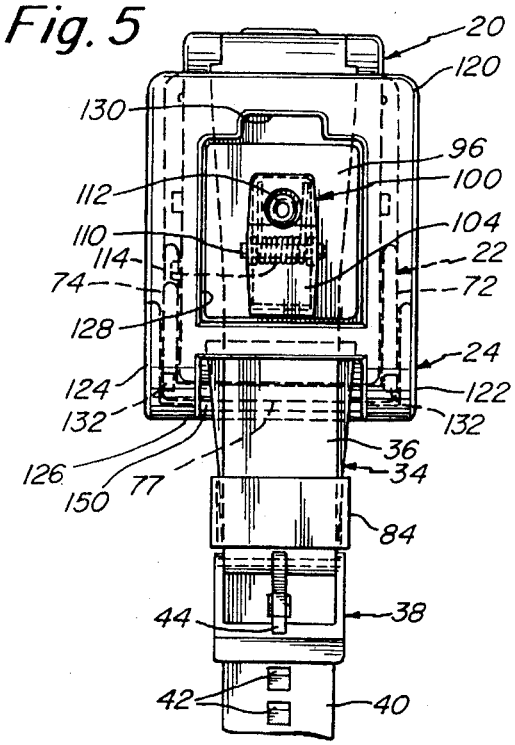
FIG. 5 is a rear elevation view of the assembly shown in FIG. 4 taken along sight line 5—5 in that figure.
Figure 6:
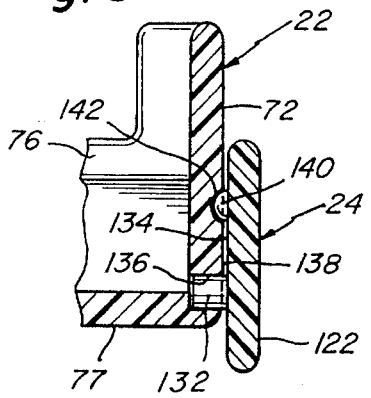
FIG. 6 is a fragmentary cross-sectional view on an enlarged scale of a portion of the cradle and stand, taken along section line 6—6 in FIG. 4.

The cradle 22 includes a rear wall 70, side walls 72 and 74, front wall 76 and bottom wall 77. The side walls, front wall, bottom wall and lower portion 79 of the rear wall 70 together define a seat 78 open at the top 80 for receiving the lower portion of the receiver 20, as clearly shown in FIGS. 1–5. A large opening 82 in the lower portion 79 of the rear wall 70 allows the band 34 of the receiver to extend out of the seat 78 when the receiver is mounted in the cradle 22. To do so, the clasp 38 should be opened to allow the straps 36 and 40 of the band 34 to lie in face to face relationship. The straps may be held against one another by threading the strap 40 through loop 84 on the other strap 36, all as shown in FIGS. 3, 4 and 5. A notch 86 is provided in the top edge 88 of side wall 74 to accommodate the lower switch 56 when the receiver is in the seat 78 of the cradle. A layer notch 87 is formed at the top of the front wall 76 of the cradle to expose the speaker 32 when the receiver is in the cradle. The notches are shown in FIGS. 1 and 2.

The lower portion of the front wall 76 of the cradle 22 is bevelled as shown at 90, and the front face 92 of the receiver housing 26 is similarly bevelled as shown at 94 so as to provide the two with matching contours to stabilize the receiver 20 in the cradle 22 when placed in the seat 78. The band 34 when threaded through the opening 82 in the cradle 22 bears against the inside face of the rear wall 70 and pushes the receiver 20 forwardly in the seat 78 so that the receiver fits rather tightly in it and does not wobble or rattle in the cradle.

The central portion 96 of the rear wall 70 is offset rearwardly above the opening 82. Portion 96 conforms approximately to the width and thickness of the upper strap 36 which may extend into the recess on the front face of rear wall 70 formed by the offset portion, when the strap is threaded through the opening 82. This may also serve to center the receiver in the cradle and prevent it from moving about in the seat 78.

The rear wall 70, as shown in FIGS. 3–5, carries a spring clip 100 composed of a pair of jaws 102 and 104 hinged together by a pair of ears 106 and 108 on the jaws and by a pin 110. The jaw 102 is riveted as suggested at 112 to the center of the offset portion 96 of the rear wall 70 of the cradle 22, and the clip 100 therefore can rotate about the axis of the rivet to vary the direction of the jaws. The jaws are biased to a closed position by a spring 114 but may readily be opened by pinching the free ends of the jaws together against the spring bias. As is described below, the clip 100 may be used to hang the receiver on a garment such as a belt, pocket or sleeve of the person attending the infant being monitored or to a drape, curtain or other fabric in the area of the attendant.

Figure 8:
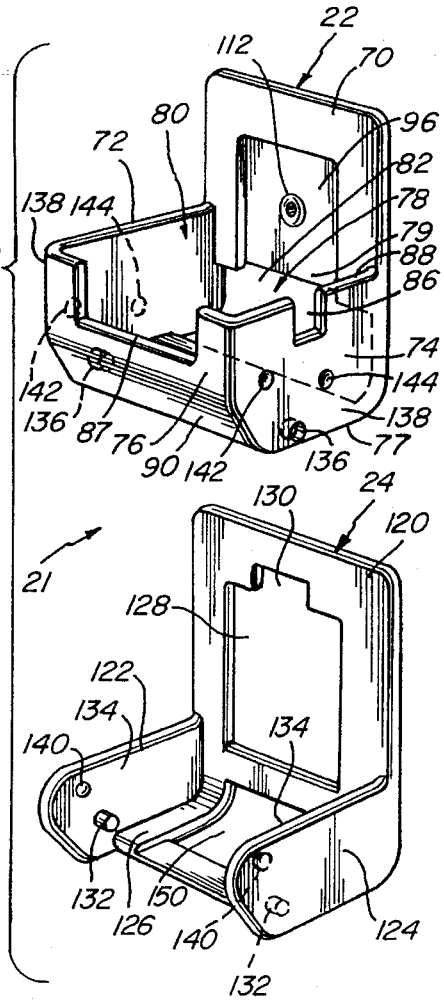
FIG. 8 is an exploded perspective view of the cradle and stand.

The stand 24 as shown in FIG. 8 somewhat mirrors the cradle 22, having a rear wall 120, side walls 122 and 124, and a bottom wall 126. The width of the stand 24 is slightly larger than the cradle 22 so that the cradle fits within the stand when the two are assembled together in nested relationship as most clearly shown in FIG. 2. The rear wall 120 of the stand has a layer opening 128 which accepts the offset portion 96 of the rear wall 70 of cradle 22 so that the cradle and stand may nest close to one another. The opening 128 has an extension 130 at its top which is large enough to allow the handle ends and the gripping ends of the jaws of clip 100 to pass through the rear wall of the stand when the cradle 22 and stand 24 are pivoted relative to one another between the positions shown in FIGS. 1 and 2.

The cradle 22 and stand 24 are permanently assembled together and interconnected by inwardly extending pivot posts 132 positioned opposite one another on the inner surfaces 134 of the side walls 122 and 124 and which register with the recesses 136 in the outer surfaces 138 of the side walls 72 and 74 of the cradle. The cradle and stand can pivot with respect to one another between the extreme positions shown in FIGS. 1 and 2 (also 3). In the position of FIGS. 1 and 3 the stand 24 supports the cradle (and the receiver 20 in it) on a flat surface such as a table or desk, and in the position of FIGS. 2 and 4 the stand essentially merges into the cradle and exposes the clip 100 through the opening 128 so that the receiver can be carried on the person or be attached to a fabric in the area of the person monitoring the child. The rear wall 120 of the stand serves as a leg for the assembly when it is placed on a table or other horizontal surface.

The cradle 22 is held in either of the two extreme positions on the stand 24 by means of a pair of detents 140 on the inner surfaces 134 of the side walls 122 and 124 of the stand and by the notches 142 and 144 on the outer surfaces 138 of the side walls 72 and 74 of the cradle. The notches 142 and 144 are approximately 75 degrees apart with respect to the recesses 136 that define the pivotal axis for the cradle and stand. By the application of a small force applied so as to separate the back panels 70 and 120 of the cradle 22 and stand 24, respectively, when the parts are in the position of FIG. 2, the detents 140 can be unseated from the notches 142, and thereafter the stand can be swung to the position of FIG. 1 wherein the detents 140 engage the notches 144. In a similar fashion the detents 140 can be released from the notches 144 to return the cradle to the position of FIG. 2. Thus, the user can readily select either of the two operative positions for the stand.

The bottom wall 126 of the stand 24 has a large opening 150 which registers with the opening 82 in the cradle. Thus, the watch band 34 can extend through the opening 150 and out of the stand when the stand is nested closely with the cradle as in FIG. 2.

From the foregoing description, it is evident that the receiver 20 can be worn as a wristwatch or alternatively can be placed in the assembled cradle 22 and stand 24 so that it can be clipped to the person (or nearby upholstery) or can be placed on a flat surface. In any of the described configurations when turned on can serve as a conventional monitor to alert a parent or other attendant of the child's state. The receiver is, of course, used in combination with a transmitter placed near the child, typically in a bedroom or nursery, which radios sounds in the room to the receiver. The receiver 20 is small, measuring in the preferred form approximately 2 inches in height, ⅞ of an inch in depth, and 1 ⅜ inches wide. The cradle measures approximately 1⅞ inches in height, 2 inches in depth (including the clip), and 1½ inches in width. The stand when in the operative position shown in FIG. 1 is approximately 2 inches in depth, 1 ⅜ inches tall, and 1¾ inches in width. Thus, the receiver can be worn comfortably on the person either as a watch or a clip-on without intefering with the normal activities of the wearer or otherwise creating a nuisance to the wearer. Alternatively, the assembly can be placed on a very small surface area and will perform its intended function as part of the baby monitor.

From the foregoing description, those skilled in the art will appreciate that numerous modifications may be made of the invention without departing from its spirit. Therefore, it is not intended that the breadth of the invention is limited to the preferred embodiment illustrated and described. Rather, its scope is to be determined by the appended claims and their equivalents.

What is claimed is:

1. A baby monitor to be used by an attendant to listen to a child in a remote location comprising:

a receiver including a housing and a strap for securing the housing about the wrist of the attendant so that it may be worn as a wristwatch, a holder having a cradle for releasably receiving the receiver, said holder including a clip for attachment to the clothing of the attendant, and a stand forming part of the holder for supporting the receiver on a flat surface.

2. A baby monitor as described in claim 1 wherein the stand and cradle are movable with respect to one another, said cradle in a first position relative to the stand nesting with the stand when the holder is to be clipped to the clothing of an attendant and the stand in a second position relative to the cradle being disposed beneath the cradle for supporting the receiver or a flat surface.

3. A baby monitor as defined in claim 2 wherein the cradle and stand are pivotally connected together and pivoting relative to reach other when the stand moves between the first and second positions.

4. A baby monitor to be used by an attendant to listen to a child in a remote location comprising a receiver having a housing and a strap connected to the housing for securing the receiver to the wrist of the attendant so that it may be worn as a wristwatch, and a holder for the receiver, said holder having a clip for hanging the receiver on the clothing of the attendant, said holder also having a support for standing the receiver on a flat surface.

5. A baby monitor as defined in claim 4 wherein said holder includes a cradle for engaging the receiver.

6. A baby monitor as defined in claim 5 wherein the support is a stand pivotally connected to the cradle.

7. A baby monitor as defined in claim 6 wherein the stand is movable between an operable position for supporting the cradle on a flat surface and an inoperable position when the clip supports the receiver on the clothing.

8. A baby monitor as defined in claim 7 wherein a detent is provided in the holder for releasably holding the stand in the operative and inoperative positions.

9. A baby monitor as defined in claim 4 wherein the receiver is removable from the holder.

10. A baby monitor as defined in claim 9 wherein the receiver is removed from the holder when the receiver is worn as a wristwatch.

11. A baby monitor as defined in claim 10 wherein said holder includes a cradle for engaging the receiver.

12. A baby monitor as defined in claim 11 wherein the support is a stand pivotally connected to the cradle.

* * * * *